US006992559B2

(12) United States Patent
Huang

(10) Patent No.: US 6,992,559 B2
(45) Date of Patent: Jan. 31, 2006

(54) OVERLOAD PROTECTION SWITCH

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 265 days.

(21) Appl. No.: 10/669,037

(22) Filed: Sep. 23, 2003

(65) Prior Publication Data

US 2005/0190521 A1 Sep. 1, 2005

(51) Int. Cl.
*H01H 73/26* (2006.01)
*H01H 73/30* (2006.01)
*H01H 37/52* (2006.01)

(52) U.S. Cl. ..... 337/66; 337/37; 337/56; 337/91

(58) Field of Classification Search ..... 337/66, 337/37, 56, 91
See application file for complete search history.

(56) References Cited

U.S. PATENT DOCUMENTS 3,534,313 A * 10/1970 Holt ..... 337/39
3,562,689 A * 2/1971 Bar ..... 337/77
4,528,538 A * 7/1985 Andersen ..... 337/43
5,223,813 A * 6/1993 Cambreleng et al. ..... 337/66
5,491,460 A * 2/1996 Krasser et al. ..... 337/70
5,936,505 A * 8/1999 Yu ..... 337/66
6,275,134 B1 * 8/2001 Chen ..... 337/37
6,469,610 B1 * 10/2002 Chen ..... 337/66
2005/0134421 A1 * 6/2005 Huang ..... 337/66

FOREIGN PATENT DOCUMENTS

DE 19746589 A1 * 5/1999

* cited by examiner

*Primary Examiner*—Anatoly Vortman
(74) *Attorney, Agent, or Firm*—Alan D. Kamrath; Nikolai & Mersereau, P.A.

(57) ABSTRACT

An overload protection switch has a conductor interconnecting the first primary leg and a second primary leg so that when current passes through the switch, the current not only raises the temperature of the bi-metal plate, but also raises the temperature of the conductor to enhance the deformation of the bi-metal plate such that the electrical appliance connected to the switch and having an ampere tolerance lower than that of the bi-metal plate is protected.

2 Claims, 5 Drawing Sheets

OVERLOAD PROTECTION SWITCH

BACKGROUND OF THE INVENTION

1. Field of the Invention

The present invention relates to a switch, and more particularly to an overload protection switch in which a conductor is provided to connect the first primary leg to the second primary leg so that not only will the current passing along the primary leg cause temperature rise in the bi-metal plate, but also the heat generated in the conductor will cause the temperature of the bi-metal plate to rise so that overload to the switch is avoided.

2. Description of Related Art

Overload protection devices provided for safety when using electrical appliances are commonly used in our daily lives. FIGS. 5 and 6 show a conventional overload protection switch. The switch has a hollow housing (50) and a button (60).

The button (60) has two bosses (600) respectively formed on two opposite sides of the button (60) to correspond to two pivot holes (500) respectively defined in opposite sides of an upper portion of the housing (50), a first leg (61) extending downward from a bottom side of the button (60) and a second leg (62) also extending downward from the bottom side of the button (60).

The housing (50) has a primary connection leg (51) securely mounted on an inner side and partially extending out of the hollow housing (50). The primary connection leg (51) is provided with a first contact (510) securely mounted on a top portion of the primary connection leg (51). A second connection leg (52) is extended out of the housing (50). A bi-metal plate (53) has a first distal end securely connected to the second connection leg (52) and a second distal end provided with a second contact (530) to correspond to the first contact (510) of the primary connection leg (51). A deformation (531) is formed in a mediate portion of the bi-metal plate (53).

When the switch is to be assembled, the two bosses (600) are respectively extended into the pivot holes (500) to allow the button (60) to pivot relative to the housing (50). After the primary leg (51) and the second connection leg (52) are securely received in the housing (50), two supports (54,55) are also securely received in the housing (50) to sandwich the dual metal plate (53). Thus, when the switch is in use, the button (60) is first pivoted to cause the second contact (530) to engage with the first contact (510) of the primary leg (51) to have the switch to be in "ON" status. When the button (60) is pivoted again, the second contact (530) is forced by the second leg (62) to leave the engagement with the first contact (510) to have the switch to be in "OFF" status, as shown in FIG. 7.

When the switch is on and if the current passing through the switch is excessive, the temperature of the bi-metal plate (53) will rise and the deformation (531) will expand to cause the separation between the first contact (510) and the second contact (530) as a consequence. Therefore, whenever there is an overload in the switch, the movement of the bi-metal plate (53) will automatically shut off the connection between the first contact (510) and the second contact (530) so that the electrical appliance electrically connected to the switch is protected from damage.

However, if the designated ampage to pass through the bi-metal plate is 3 A and the electrical appliance connected to the switch has an ampage tolerance lower than 3 A, the movement of the bi-metal plate will not protect the appliance from overloading.

To overcome the shortcomings, the present invention tends to provide an improved overload protection switch to mitigate the aforementioned problems.

SUMMARY OF THE INVENTION

The primary objective of the present invention is to provide an improved overload protection switch having a conductor connecting the first primary leg to the second primary leg and being adjacent to the bi-metal plate so that not only will the current passing through the bi-metal plate raise the temperature of the bi-metal plate, but also the current passing through the conductor will raise the temperature of the conductor, which in return will speed up the deformation of the bi-metal plate and thus the appliance is protected from overloading.

Other objects, advantages and novel features of the invention will become more apparent from the following detailed description when taken in conjunction with the accompanying drawings.

DETAILED DESCRIPTION OF THE PREFERRED EMBODIMENT

Figure 1:
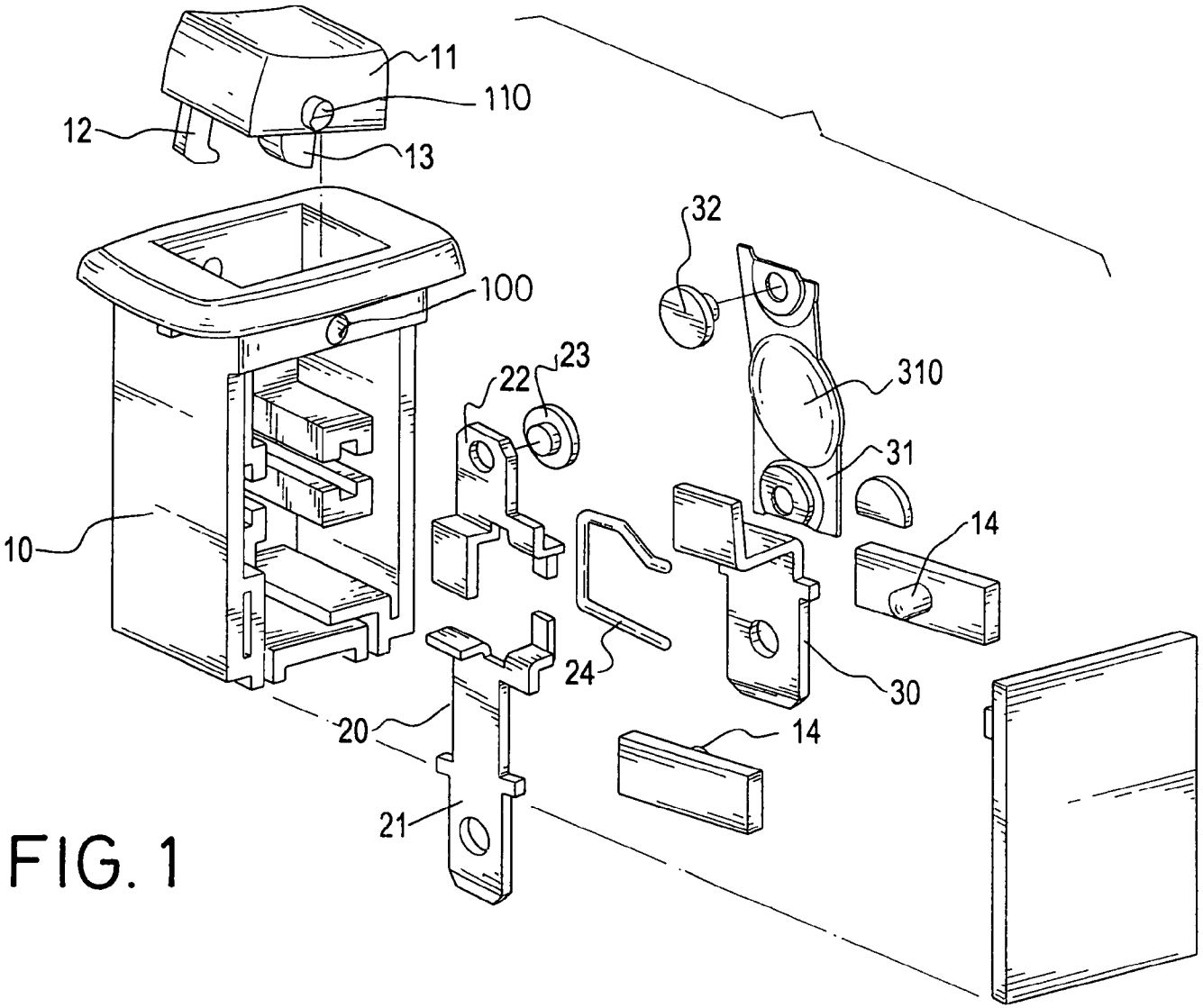
FIG. 1 is an exploded perspective view of the switch of the present invention.
Figure 2:
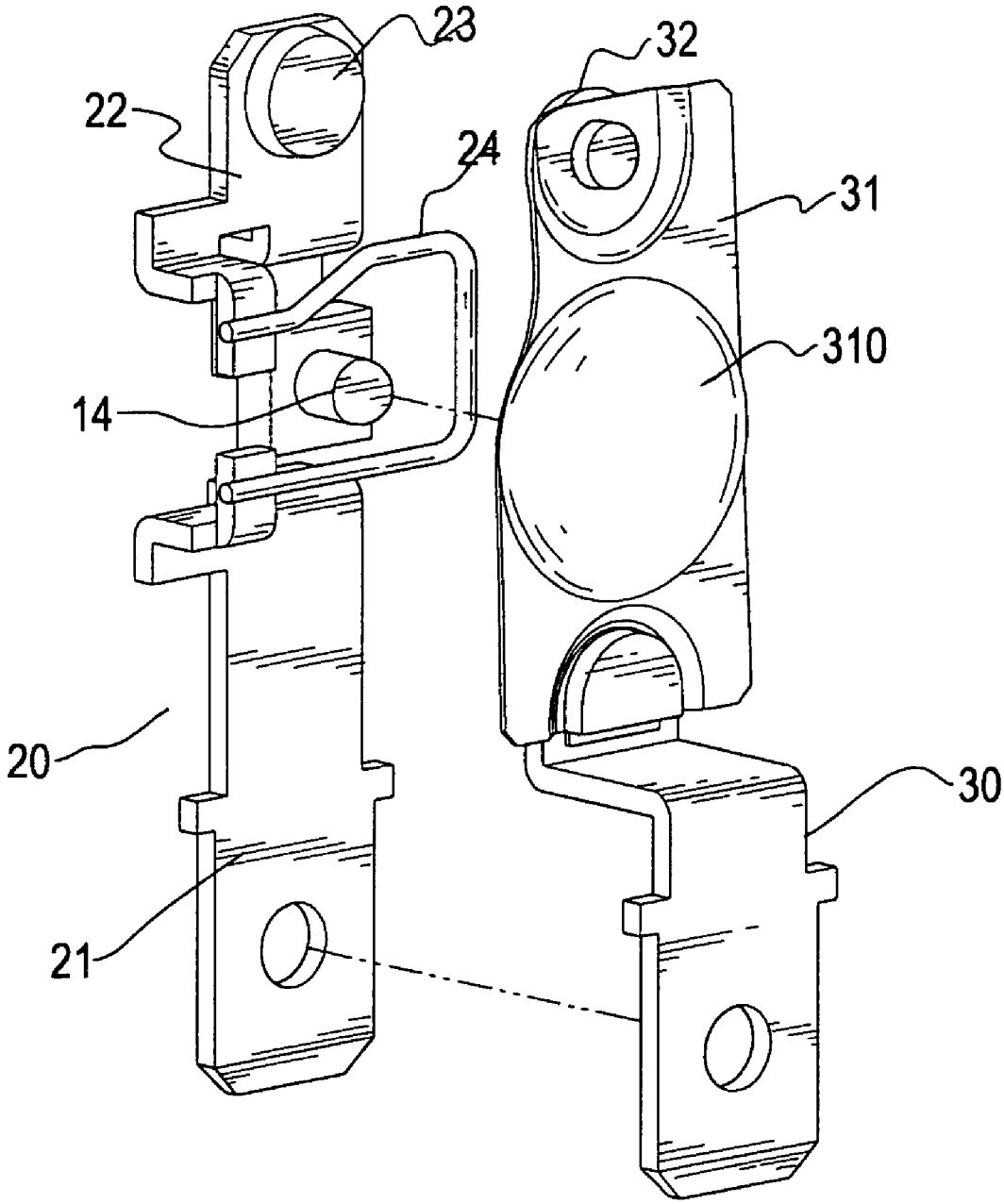
FIG. 2 is an exploded perspective view of the primary leg and the second primary leg.

With reference to FIGS. 1 and 2, the overload protection switch in accordance with the present invention includes a hollow housing (10) with a button (11) pivotally engaged with a top portion of the housing (10), a primary leg (20), a second primary leg (30) and a bi-metal plate (31).

The housing (10) has two pivot holes (100) respectively defined in opposite sides of the upper portion of the housing (10) to correspond to two bosses (110) respectively formed on two opposite sides of the button (11). The button (11) has a first extension (12) and a second extension (13).

The primary leg (20) is securely attached to an inner side of the housing (10) and divided into a first portion (21) partially extending out of the housing (10) and a second portion (22) received in the housing (10). The second portion (22) is provided with a first contact (23) formed on a distal end of the second portion (22). A conductor (24) is provided to be sandwiched between the first portion (21) and the second portion (22) and the first and the second portions (21,22) are so configured that after the conductor (24) is applied to connect the first portion (21) to the second portion (22), each of the distal ends of the conductor (24) is connected with both the first and second portions.

The second primary leg (30) is securely received in the housing (10) and has a lower portion extending out of the housing (10). The bi-metal plate (31) is loosely yet securely connected to an upper portion of the second primary leg (30) and has a second contact (32) securely mounted on a top portion of the bi-metal plate (31) to correspond to the first contact (23) of the second portion (22) of the primary leg (20).

Figure 4:
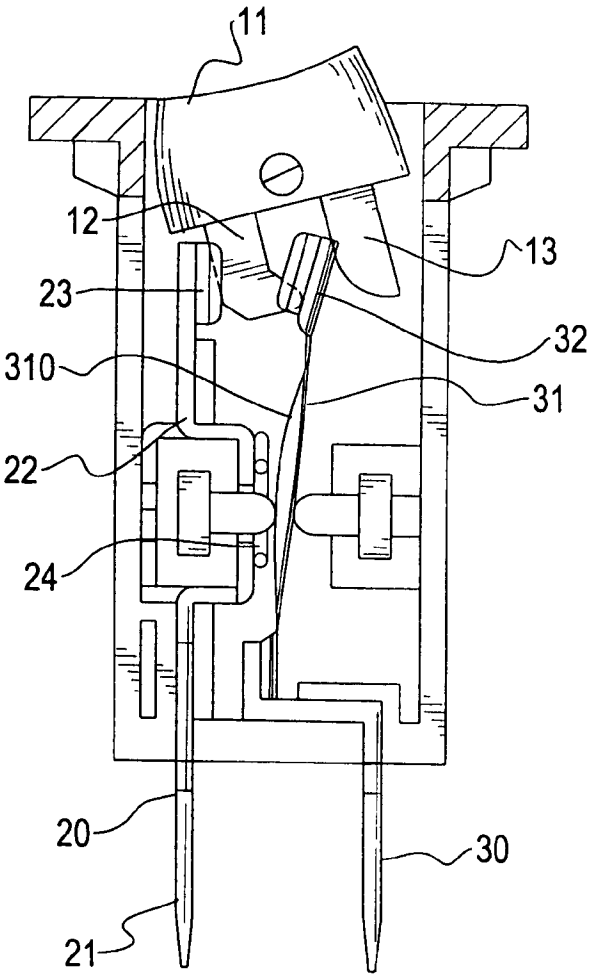
FIGS. 3 and 4 are schematic views showing the switch in different modes.
Figure 3:
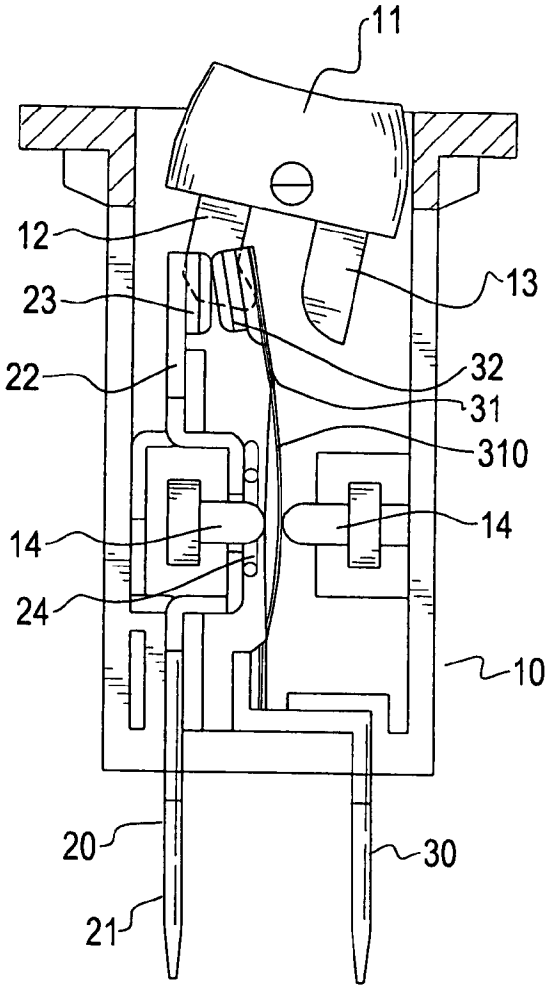
Figure 5:
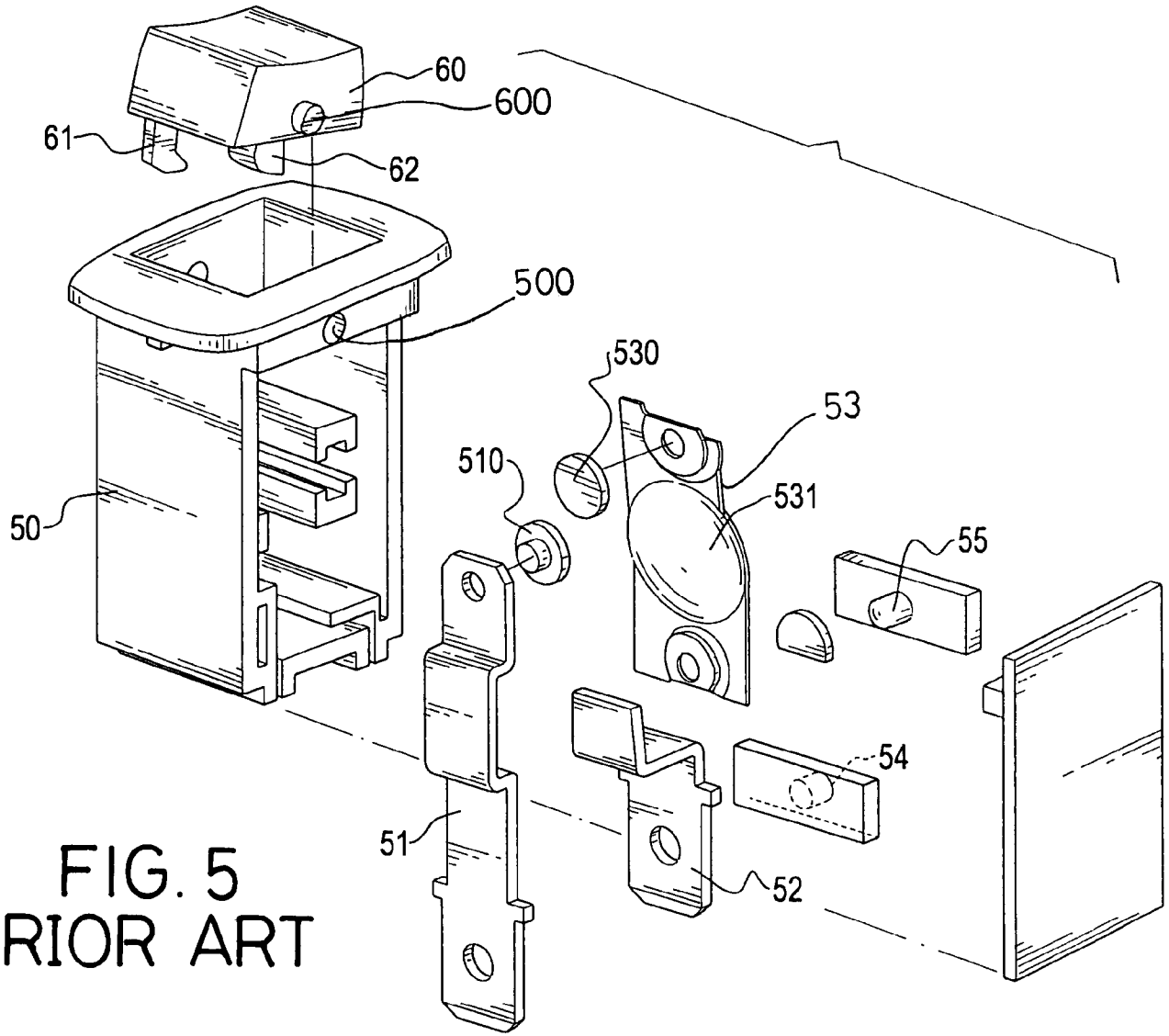
FIG. 5 PRIOR ART
FIG. 5 is an exploded perspective view of a conventional switch.
Figure 7:
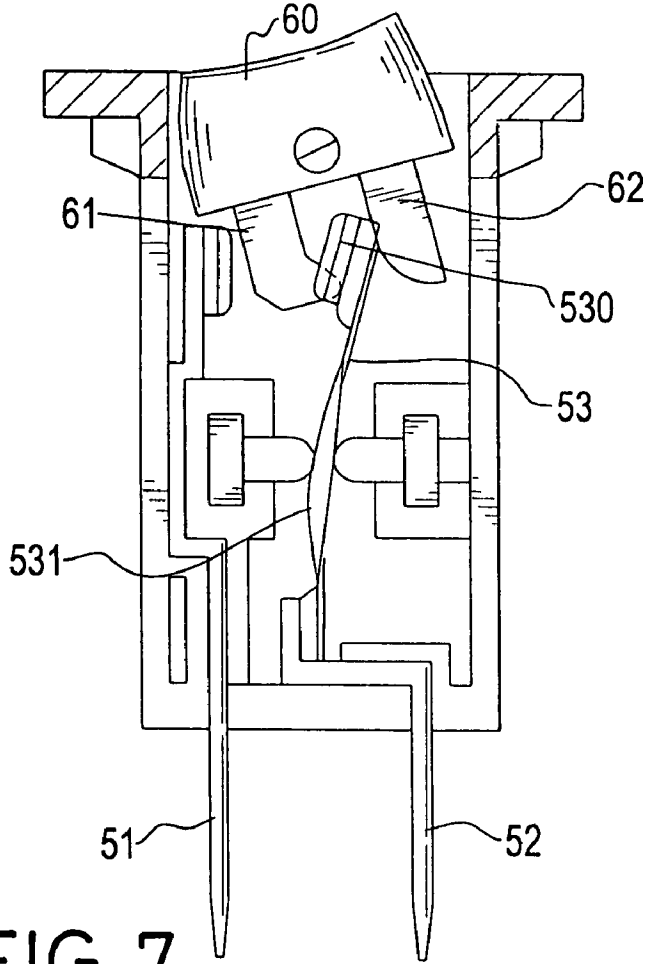
FIG. 7 PRIOR ART
FIGS. 6 and 7 are schematic side plan views showing the conventional switch in different modes.
Figure 6:
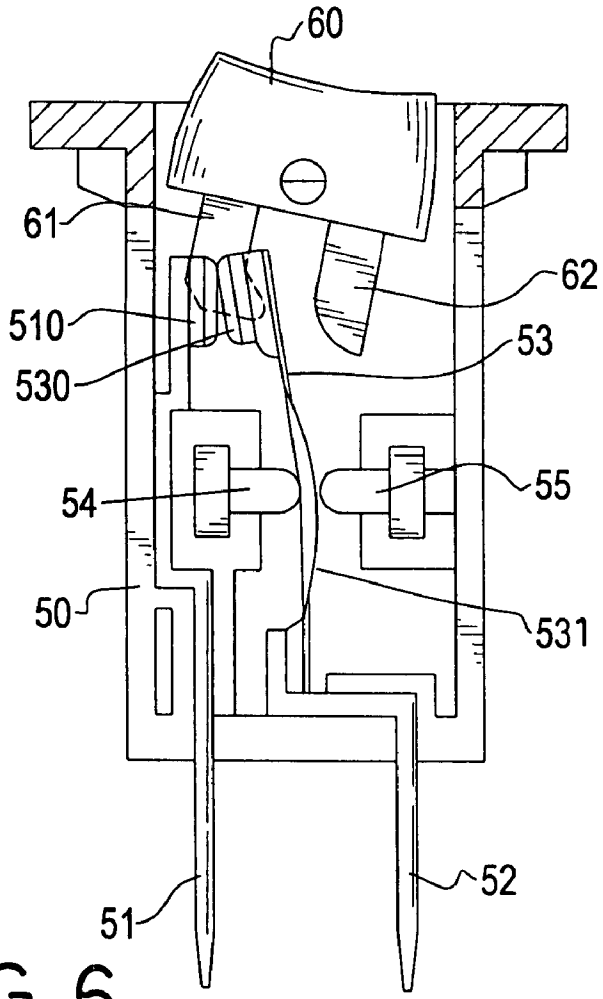
FIG. 6 PRIOR ART

With reference to FIGS. 3 and 4, when the switch of the present invention is in assembly, the button (11) is mounted on the top portion of the housing (10) with the two bosses (110) respectively received in the the pivot holes (100) of the housing (10) to allow the button (11) to pivot relative to the housing (10).

After the conductor (24) is securely sandwiched between the first portion (21) and the second portion (22) and the bi-metal plate (31) is securely connected to the upper portion of the second primary leg (30), the primary leg (20) and the second primary leg (30) are respectively arranged in the housing (10) to securely engage with an inner side face of the housing (10). Two supports (14) are respectively and oppositely formed on two inner side faces of the housing (10) to sandwich the bi-metal plate (31) to enhance the deformation of the bi-metal plate (31).

After assembly and when the button (11) is pivoted to a first position, the second extension (13) forces the second contact (32) to engage with the first contact (23) to have the switch in an "ON" mode. When the button (11) is pivoted again to a second position, the first extension (12) forces the first contact (23) and the second contact (32) to separate from each other so as to place the switch of the present invention in an "OFF" mode.

However, while the switch is in the "ON" mode, the current passing through the primary leg (20) will cause temperature rise of the conductor (24) which is adjacent to the deformation (310) of the bi-metal plate (31). Thus, not only will the temperature of the bi-metal plate (31) rise due to the current passing through the second primary leg (30), but also the temperature of the conductor (24) will enhance the temperature rise of the bi-metal plate (31) such that even when the current does not reach the designed load of the switch, the double heating effect to the bi-metal plate (31) protects the sensitive electrical appliance from damage of overloading.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An overload protection switch comprising:

a housing;

a button pivotally connected to an upper portion of the housing and having a first extension and a second extension both extending from a bottom face of the button;

a primary leg securely engaged with an inner side face of the housing and partially extending out of the housing, the primary leg having a first contact securely mounted on a top portion of the primary leg;

a conductor securely attached to the primary leg;

a second primary leg securely received in the housing and partially extending out of the housing; and a bi-metal plate securely connected to a top portion of the second primary leg and having a second contact securely mounted on a top portion of the bi-metal plate to selectively engage with the first contact and a deformation formed on a mediate portion of the bi-metal plate, whereby current passing through the switch will raise the temperature of the bi-metal plate as well as the temperature of the conductor so that the deformation of the bi-metal plate is forced to deform in advance to protect a sensitive electrical appliance connected to the switch.

2. The switch as claimed in claim 1, wherein the housing further has two supports respectively formed on opposite inner side faces of the housing to sandwich the bi-metal plate.

* * * * *